US008755926B2

(12) United States Patent
Naka

(10) Patent No.: US 8,755,926 B2
(45) Date of Patent: Jun. 17, 2014

(54) SEWING MACHINE WITH IMAGE SYNTHESIS UNIT

(75) Inventor: Takafumi Naka, Ama (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 155 days.

(21) Appl. No.: 13/415,472

(22) Filed: Mar. 8, 2012

(65) Prior Publication Data

US 2012/0234222 A1 Sep. 20, 2012

(30) Foreign Application Priority Data

Mar. 14, 2011 (JP) ..... 2011-055413

(51) Int. Cl.
*D05B 19/00* (2006.01)

(52) U.S. Cl.
USPC ..... 700/137; 112/470.03

(58) Field of Classification Search
USPC ..... 700/136–138; 112/470.13, 470.12
See application file for complete search history.

(56) References Cited

U.S. PATENT DOCUMENTS 4,526,116 A * 7/1985 Mannel ..... 112/475.19
4,612,867 A * 9/1986 Rosch et al. ..... 112/470.03
4,766,828 A * 8/1988 Nomura et al. ..... 112/314
4,784,071 A * 11/1988 Sadeh et al. ..... 112/470.07
4,849,902 A * 7/1989 Yokoe et al. ..... 112/470.04
4,901,659 A * 2/1990 Nomura et al. ..... 112/470.03
4,982,674 A * 1/1991 Hayakawa ..... 112/102.5
4,982,677 A * 1/1991 Nomura et al. ..... 112/314
5,001,998 A * 3/1991 Suzuki et al. ..... 112/314
5,103,749 A * 4/1992 Geisselmann et al. ... 112/475.03
5,107,780 A * 4/1992 Braun ..... 112/314
5,161,476 A * 11/1992 Suzuki ..... 112/306
5,189,969 A * 3/1993 Ito et al. ..... 112/470.01
5,323,722 A * 6/1994 Goto et al. ..... 112/102.5
5,537,946 A * 7/1996 Sadeh et al. ..... 112/475.03
5,754,431 A * 5/1998 Kotaki ..... 700/97
6,263,815 B1 * 7/2001 Furudate ..... 112/470.13
6,994,042 B2 * 2/2006 Schweizer ..... 112/470.03
7,620,472 B2 * 11/2009 Hamajima ..... 700/136
7,848,842 B2 * 12/2010 Suzuki et al. ..... 700/136
8,061,286 B2 * 11/2011 Hirata et al. ..... 112/470.01
8,301,292 B2 * 10/2012 Tokura ..... 700/138

(Continued)

FOREIGN PATENT DOCUMENTS

JP A-4-256772 9/1992
JP A-7-313771 12/1995

(Continued)

*Primary Examiner* — Danny Worrell
(74) *Attorney, Agent, or Firm* — Oliff PLC

(57) ABSTRACT

A sewing machine includes a needle position detector configured to detect whether or not a needle is located at a needle-down position or a needle-up position, a first imaging member configured to image a first range of an underside of workpiece cloth while the workpiece cloth is being moved, a second imaging member configured to image a second range of the underside of the workpiece cloth while the workpiece cloth is being moved, an imaging control unit configured to control an imaging process so that the imaging process is executed when the needle is located at the needle-up position, based on detection result and so that the imaging process is stopped when the needle is located at the needle-down position, an image synthesis unit configured to synthesize the images obtained by the imaging units, thereby obtaining a synthesized image, and a display unit configured to display the synthesized image.

16 Claims, 8 Drawing Sheets

(56) References Cited

U.S. PATENT DOCUMENTS

| | | | | |
|---|---|---|---|---|
| 8,463,420 | B2 * | 6/2013 | Tokura | 700/137 |
| 8,527,083 | B2 * | 9/2013 | Tokura | 700/138 |
| 2005/0115482 | A1 * | 6/2005 | Schweizer | 112/470.01 |
| 2006/0283365 | A1 | 12/2006 | Niizeki et al. | |
| 2010/0199902 | A1 | 8/2010 | Mori et al. | |
| 2012/0209417 | A1 * | 8/2012 | Tokura | 700/138 |

FOREIGN PATENT DOCUMENTS

| | | |
|---|---|---|
| JP | A-2006-346087 | 12/2006 |
| JP | A-2010-184032 | 8/2010 |
| JP | A-2010-184033 | 8/2010 |

* cited by examiner

| SHOT_TIME | THRESHOLD |
|---|---|
| 1msec — 5msec | 30 |
| 5msec — 10msec | 60 |
| 10msec — 15msec | 90 |
| 15msec — 20msec | 120 |

LARGE ← CLOTH FEED AMOUNT → SMALL

FIG. 7

SEWING MACHINE WITH IMAGE SYNTHESIS UNIT

CROSS-REFERENCE TO RELATED APPLICATIONS

This application is based upon and claims the benefit of priority from the prior Japanese Patent Application No. 2011-055413 filed on Mar. 14, 2011, the entire contents of which are incorporated herein by reference.

BACKGROUND

1. Technical Field

The present disclosure relates to a sewing machine which is provided with a cloth feed mechanism for moving a workpiece cloth on a sewing machine bed.

2. Related Art

When a sewing machine which sews a workpiece cloth is used to sew, for example, two cloths in a superimposed or overlapped state, a failure such as a positional shift between the cloths sometimes occurs during sewing. In this case, the user cannot view an underside of the lower workpiece cloth although he or she can view an upper surface of the upper workpiece cloth. In view of the aforementioned failure, sewing machines are provided with a workpiece cloth recognizing device which detects the shift between the workpiece cloths by imaging the workpiece cloths from above and from below by an imaging unit when workpiece cloths are sewn in the superimposed state.

Failures other than the aforementioned shift between the superimposed workpiece cloths sometimes occur in stitches on the underside of the lower workpiece cloth during sewing of the workpiece cloths by the sewing machine. Furthermore, another failure in stitches such as bird's nest sometimes occurs in sewing machines which can sew embroidery patterns on the workpiece cloth. The bird's nest is an entanglement of a needle thread at the underside of the workpiece cloth during the sewing of an embroidery pattern. In a case where the sewing is continued without user's finding the stitch failure, a large amount of thread would thereafter need to be disentangled such that the thread would be wasted. Additionally, disentangling the thread would damage the workpiece cloth. As a result, it is desirable that the failures during the sewing should be early detected.

However, when an imaging unit is disposed in front of a sewing machine bed, the presence or absence of shift between the workpiece cloths is detected at the location ahead of the sewing machine bed. This renders, impossible, detection of the state of the workpiece cloth during or after sewing and the state of stitches at the underside of the workpiece cloth. Furthermore, a cloth feed mechanism, a shuttle mechanism and the like are housed in the bed on which the workpiece cloth is to be placed. This increases the size of the bed when the imaging unit is housed in the bed to image the underside of the workpiece cloth.

SUMMARY

Therefore, an object of the disclosure is to provide a sewing machine which can early detect a failure occurring during sewing without rendering the bed large-sized.

The present disclosure provides a sewing machine including a sewing machine bed configured so that a workpiece cloth is placed thereon, a feed mechanism provided in the bed and configured to move the workpiece cloth in a predetermined direction, a needle bar to which a needle is attached, a needle bar mechanism configured to drive the needle bar upward and downward, a needle position detector configured to detect whether or not the needle is located at a needle-down position where the needle penetrates the workpiece cloth or a needle-up position where the needle is located above the workpiece cloth, a first imaging member provided on the bed and configured to image a first range of an underside of the workpiece cloth while the workpiece cloth is being moved by the feed mechanism, a second imaging member provided on the bed and configured to image a second range of the underside of the workpiece cloth while the workpiece cloth is being moved by the feed mechanism, the second range differing from the first range, an imaging control unit configured to control an imaging process so that the imaging process is executed by the first imaging unit and the second imaging unit when the needle is located at the needle-up position, based on a result of detection by the needle position detector and so that the imaging process by the first and second imaging units is stopped when the needle is located at the needle-down position, an image synthesis unit configured to synthesize the images obtained by the first and second imaging units, thereby obtaining a synthesized image, and a display unit configured to display the synthesized image obtained by the image synthesis unit.

The disclosure also provides a sewing machine including a sewing machine bed configured so that a workpiece cloth is placed thereon, a feed mechanism provided in the bed and configured to move the workpiece cloth in a predetermined direction, a needle bar to which a needle is attached, a needle bar mechanism configured to drive the needle bar upward and downward, a needle position detector configured to detect whether or not the needle is located at a needle-down position where the needle penetrates the workpiece cloth or a needle-up position where the needle is located above the workpiece cloth, an imaging member provided on the bed and having a plurality of imaging devices arranged in a direction intersecting the predetermined direction in which the workpiece cloth is moved by the feed mechanism, the imaging member being configured to image an underside of the workpiece cloth while the workpiece cloth is being moved by the feed mechanism, an imaging control unit configured to control an imaging process so that the imaging process is executed by the imaging member when the needle is located at the needle-up position, based on a result of detection by the needle position detector and so that the imaging process by the first and second imaging units is stopped when the needle is located at the needle-down position, based on a result of detection at the needle-down position, based on a result of detection by the needle position detector, and a display unit configured to display the image obtained by the imaging unit.

BRIEF DESCRIPTION OF THE DRAWINGS

In the accompanying drawings:

FIG. 7 shows the relationship between imaging interval and threshold; and

DETAILED DESCRIPTION

Figure 1:
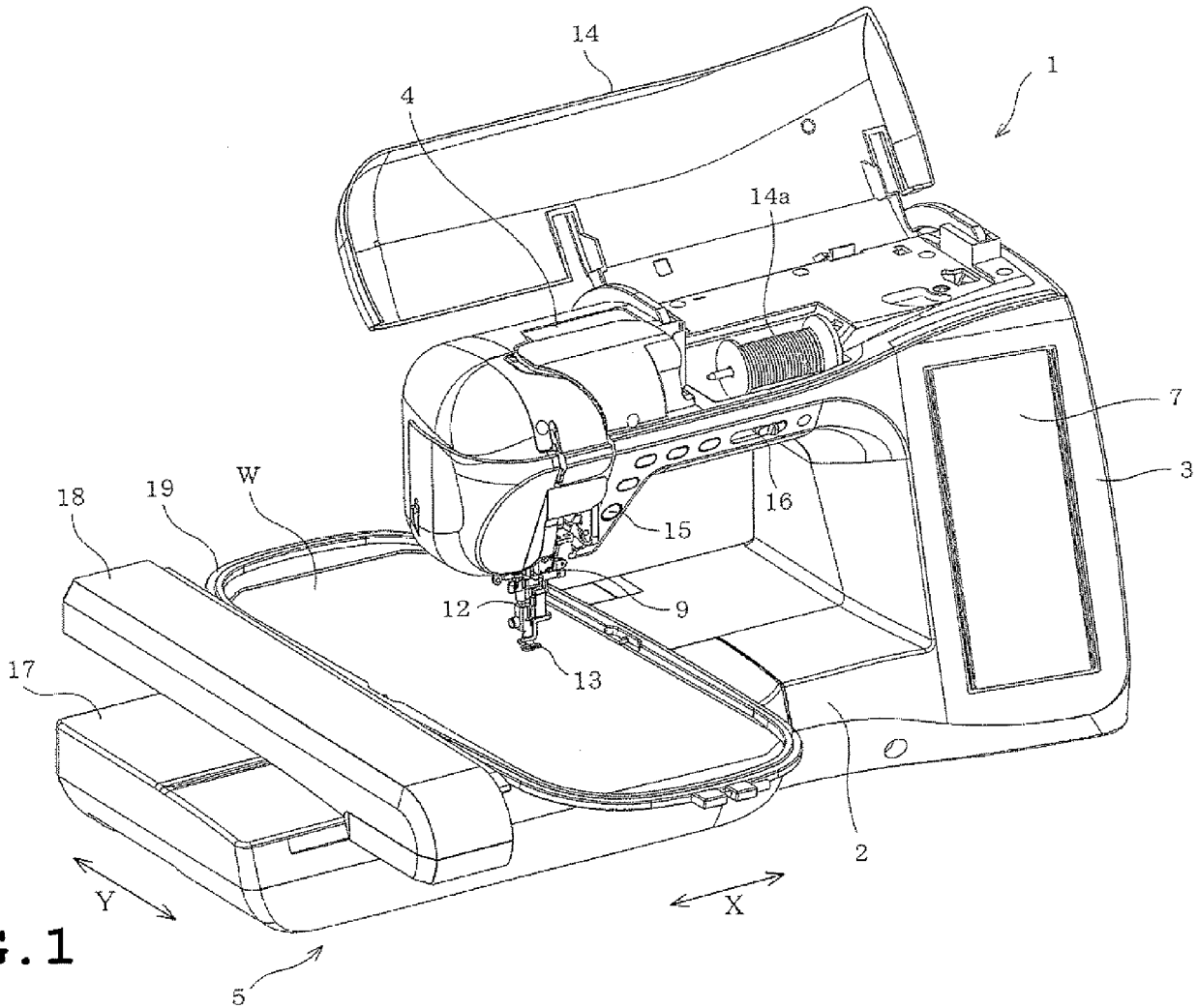
FIG. 1 is a perspective view of an overall sewing machine according to a first embodiment thereof.

A first embodiment will be described with reference to FIGS. 1 to 7. Referring to FIG. 1, a sewing machine 1 includes a sewing machine bed 2, a pillar 3, an arm 4 and an embroidery frame transfer device 5. In the following description, the side where the user who operates the sewing machine stands will be referred to as "front" and the opposite side will be referred to as "back." The front-back direction thereof will be referred to as "Y direction" as shown in FIG. 1. Furthermore, the side where the pillar 3 is located will be referred to as "right" and the opposite side will be referred to as "left." The right-left direction of a sewing machine 1 will be referred to as "X direction."

The bed 2 extends in the X direction and is placed on a work table (not shown). The bed 2 houses a shuttle mechanism, a thread cutting mechanism and the like although neither is shown. The bed 2 also houses a cloth feed mechanism 6 (see FIG. 4). The cloth feed mechanism 6 moves a workpiece cloth (not shown) to be placed on an upper surface of the bed 2 in the Y direction (the front-back direction) serving as a first feed direction and in the X direction (the right-left direction) serving as a second feed direction. Since the cloth feed mechanism 6 has a known construction, a detailed description thereof will be eliminated.

The pillar 3 extends upward from a right end of the bed 2. The pillar 3 houses a sewing machine motor 8*a* (see FIG. 4) and has a front surface on which is mounted a display 7 comprising a liquid-crystal (LC) display capable of full-color display. The display 7 is adapted to display various sewing patterns such as embroidery patterns, function names for execution of various functions necessary for sewing, a setting screen for setting a color of embroidery pattern or the like. Furthermore, the display 7 is provided with a touch panel (not shown) comprising transparent electrodes. When depressing the touch panel with his/her finger or a touch pen, the user can select an embroidery pattern, designate various functions or set various parameters.

The arm 4 extends leftward from an upper end of the pillar 3 in parallel to the bed 2. The arm 4 houses a main shaft 8 (see FIG. 4) extending in the X direction. The main shaft 8 is rotated by a sewing machine motor 8*a*. To the left of the arm 4 are provided a needle bar mechanism 10 (see FIG. 4) driving a needle bar 9 upward and downward by the rotation of the main shaft 8, a needle bar swinging mechanism (not shown) swinging the needle bar 9 in a direction (X direction) perpendicular to the cloth feed direction, a needle thread take-up drive mechanism (not shown) moving a needle thread take-up (not shown) upward and downward in synchronization with the upward and downward movement of the needle bar 9, a presser bar drive mechanism (not shown) moving a presser bar 11 (see FIG. 2) upward and downward, and the like. A detailed description of these mechanisms will be eliminated since their constructions are known. On the left lower part of the arm 4 are provided the needle bar 9 to which the needle 12 is attached and the presser bar 11 provided with a presser foot 13.

A cover 14 is pivotally mounted on the arm 4 to openably close an upper side of the arm 4. The arm 4 has an interior including a housing space for housing a thread spool 14*a*. A needle thread drawn from the thread spool 14*a* is supplied through a thread supply route including the needle thread take-up to the needle 12. Various switches are mounted on the front of the arm 4. These switches include a start/stop switch 15 instructing start and stop of sewing and a speed adjusting knob 16 for adjusting a sewing speed or a rotational speed of the main shaft 8.

An embroidery frame transfer device 5 is detachably attached to a left part of the bed 2. The embroidery frame transfer device 5 includes a body 17 which is designed to be level with the upper surface of the bed 2 when the device 5 is attached to the bed, and a moving part 18 which is mounted on an upper part of the body 17 so as to be movable in the X direction. The moving part 18 includes a carriage (not shown) which is movable in the Y direction so that an embroidery frame 19 holding a workpiece cloth W serving as an object to be sewn is detachably coupled to the carriage.

The embroidery frame transfer device 5 also includes an X-direction transfer mechanism 5*a* (see FIG. 4) driving the carriage in the X direction together with the moving part 18. The embroidery frame 19 coupled to the carriage is freely moved in the X and Y directions by drive motors (not shown) of the respective X-direction and Y-direction transfer mechanisms 5*a* and 5*b* based on embroidery data of the embroidery frame, whereby an embroidery pattern is formed on the workpiece cloth W.

Figure 2:
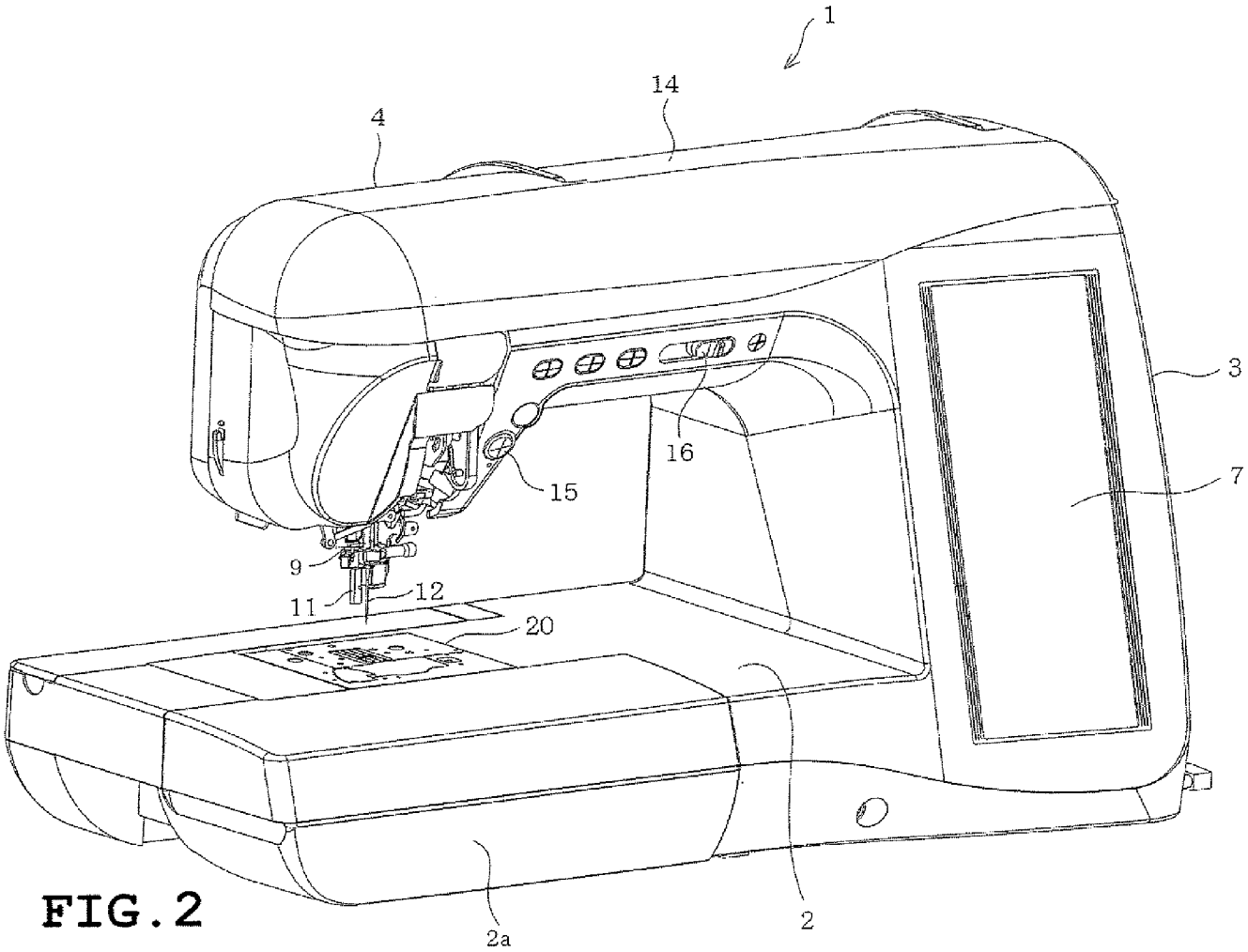
FIG. 2 is also a perspective view of the sewing machine with an embroidery frame transfer device being detached.

A needle plate 20 is mounted on the upper surface of the bed 2 as shown in FIG. 2. The needle plate 20 is formed into a generally rectangular shape and includes a first needle plate 21 which is fixed to the bed 2 and a second needle plate 22 which is detachably attached to the first needle plate 21. The first needle plate 21 is made of, for example, a metal material and formed into a rectangular shape. The first needle plate 21 has a first or needle hole 23 through which the needle 12 is passable and a plurality of, for example, seven second or feed-dog holes 24. The feed dog (not shown) is moved out of and into the feed-dog holes 24. The needle hole 23 extends in the X direction and is formed into an elliptical shape. Each feed-dog hole 24 extends in the Y direction and is formed into a rectangular shape. The feed-dog holes 24 are formed so as to surround the needle hole 23. The first needle plate 21 has two screw holes which are used to fix the plate 21 to the bed 2 in cooperation with screws (not shown).

The second needle plate 22 is made of a metal material, for example. The second needle plate 22 is formed into a flat shape and further into a substantial L-shape following a front edge and a left edge of the first needle plate 21. The second needle plate 22 is detachably attached to the first needle plate 21 fixed to the bed 2. When the second needle plate 22 is attached to the first needle plate 21 fixed to the bed 2, upper surfaces of the first and second needle plates 21 and 22 are coplanar or on a level with each other. The second needle plate 22 has an opening 26 which is located in the middle with respect to the X direction and through which a bobbin (not shown) is attached to a shuttle mechanism. The opening 26 is closed by a needle plate lid 27 during sewing.

Figure 3:
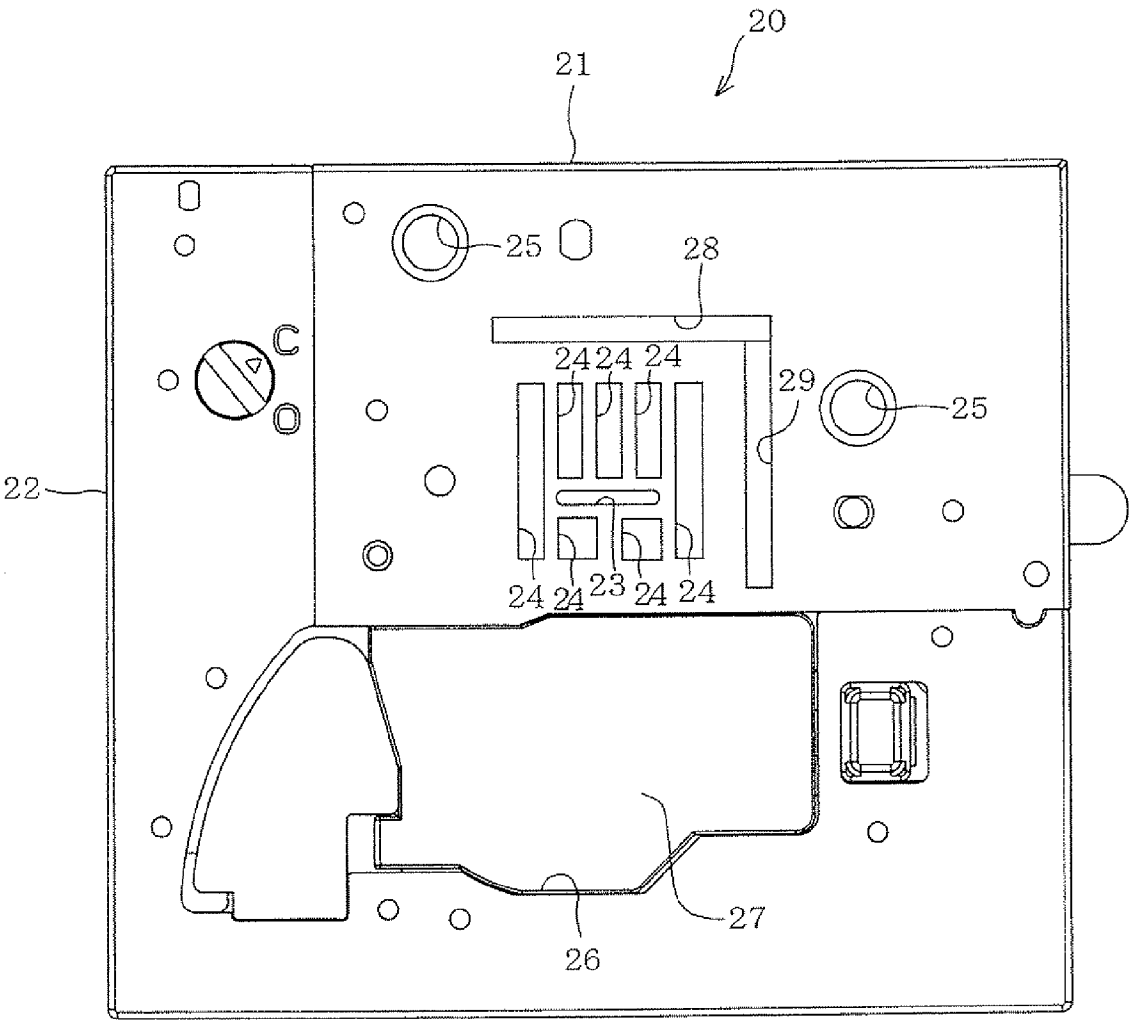
FIG. 3 is a plan view of a needle plate.

The first needle plate 21 further has a first rectangle hole 28 formed in the rear of the feed-dog holes 24 and a second rectangle hole 29 formed in the right of the feed-dog holes 24, so that the first and second rectangle holes 28 and 29 occupy respective locations near the feed-dog hole 24, as shown in FIG. 3. The rectangle holes 28 and 29 are formed through the first needle plate 21. The first rectangle hole 28 is formed into a rectangular shape and extends in the X direction (the right-left direction), while the second rectangle hole 29 is formed into a rectangular shape and extends in the Y direction (the front-back direction). The first rectangle hole 28 has a right front end and the second rectangle hole 29 has a rear end. The first and second rectangle holes 28 and 29 are formed so that the right front end of the first rectangle hole 28 and the rear end of the second rectangle hole 29 are adjacent to each other.

A first imaging member 30 (see FIG. 4) and a second imaging member 31 (see FIG. 4) are mounted in the first and second rectangle holes 28 and 29 respectively. The first and second imaging members 30 and 31 serve as first and second imaging units respectively. Each one of the first and second imaging members 30 and 31 comprises a contact image sensor (CIS) which can image an underside of the workpiece cloth W while being in contact with an underside part of the workpiece cloth W placed on the upper surface of the needle plate 20.

The first imaging member 30 comprises a line sensor further comprising a plurality of imaging devices arranged in the X direction, a light source and a lens all of which are formed integrally with one another. The second imaging member 31 comprises a line sensor further comprising a plurality of imaging devices arranged in the Y direction, a light source and a lens all of which are formed integrally with one another. Since the plural imaging devices of each imaging member are arranged in a single direction, an outline and a mounting space of each imaging member can be reduced in a direction perpendicular to the direction in which the imaging devices are arranged. Although capable of obtaining full-color images, the first and second imaging members 30 and 31 may be capable of obtaining monochrome images, instead.

The first and second imaging members 30 and 31 are formed into rectangular parallelepiped shapes such that the imaging members 30 and 31 are mountable in the first and second rectangle holes 28 and 29, respectively. The first and second imaging members 30 and 31 are mounted in the first and second rectangle holes 28 and 29 respectively so that upper surfaces of the imaging members 28 and 29 are coplanar with or on a level with an upper surface of the first needle plate 21. The first and second imaging members 30 and 31 are provided in the sewing machine bed with respective upper surfaces being exposed. More specifically, the first and second imaging members 30 and 31 are brought into contact with the underside of the workpiece cloth W. The first imaging member 30 images the underside of the workpiece cloth W which is moved in the Y direction by the cloth feed mechanism 6 or the embroidery frame transfer device 5. In the same manner, the second imaging member 31 images the underside of the workpiece cloth W which is in motion in the X direction by the cloth feed mechanism 6 or the embroidery frame transfer device 5. In this case, a range imaged or covered by the first imaging member 30 serves as a first range, and a range imaged or covered by the second imaging member 31 serves as a second range.

Figure 4:
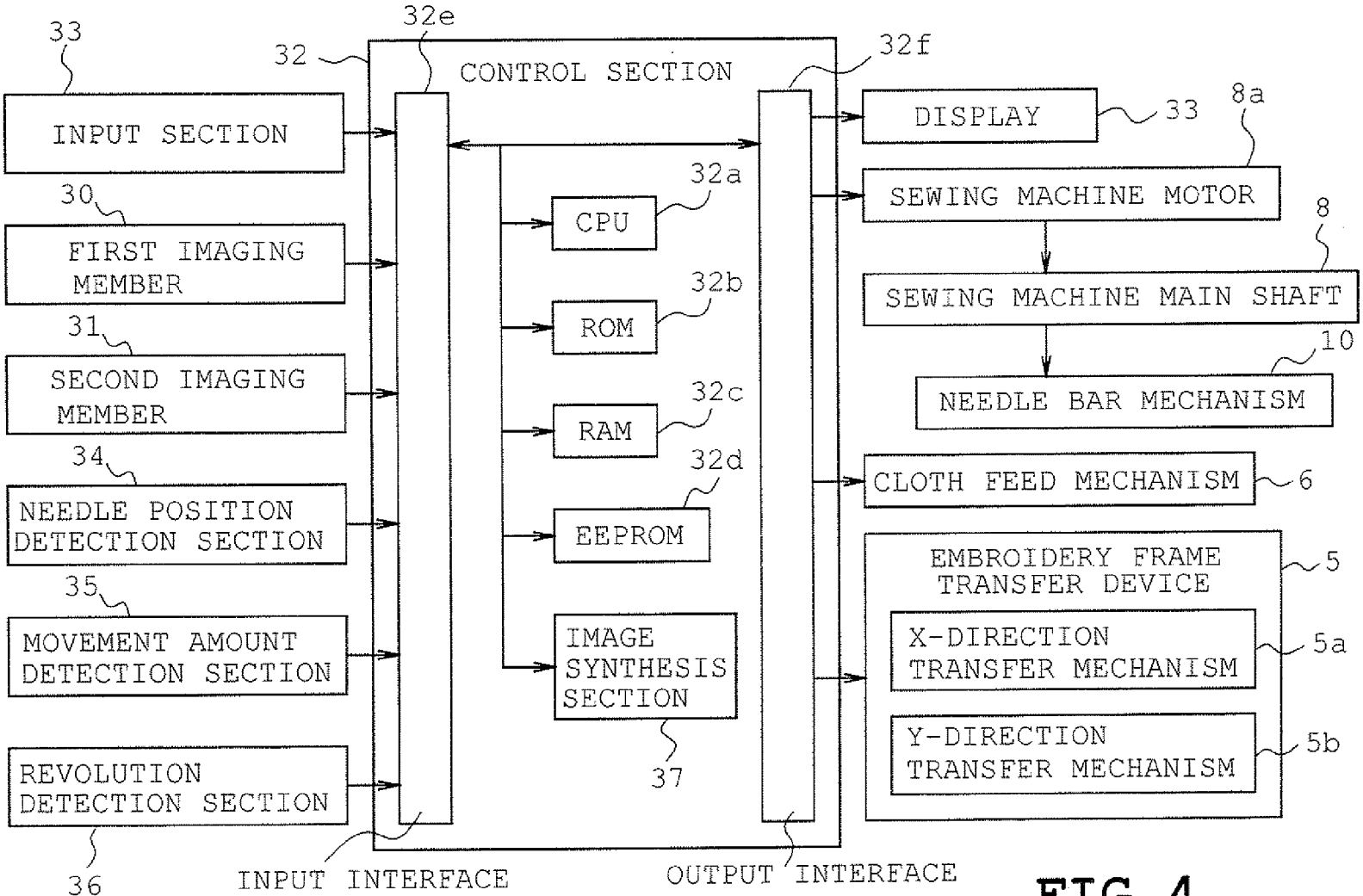
FIG. 4 is a schematic block diagram showing an electrical arrangement of the sewing machine.

An electrical arrangement of the sewing machine 1 will now be described with reference to FIG. 4. A control section 32 is mainly composed of a microcomputer including a CPU 32*a*, a ROM 32*b*, a RAM 32*c*, an EEPROM 32*d*, an input interface 32*e* and an output interface 32*f*. The control section 32 also comprises an image synthesis section 37 which serves as an image synthesis unit and which will be described in detail later. The control section 32 may be configured so that a memory card (not shown) serving as an external storage medium is connectable thereto. The ROM 32*b* of the control section 32 stores sewing data for ordinary sewing, embroidery data of embroidery patterns, a sewing control program, a display control program for controlling a displaying operation of the display 7 and the like. Alternatively, these data and the program may be stored on the EEPROM 32*d* or an external storage medium such as a memory card.

To the control section 32 are connected the input section 33 including the aforementioned start/stop switch 15 and the speed adjusting knob 16, the display 7, the sewing machine motor 8*a*, and the first and second imaging members 30 and 31. A needle position detection section 34, a movement amount detection section 35 and a revolution detection section 36 are also connected to the control section 32. The control section 32 controls the entire sewing machine 1 including the embroidery frame transfer device 5, the cloth feed mechanism 6 and the sewing machine motor 8*a* based on the control program stored on the ROM 32*b* etc. The control section 32 also functions as an imaging control unit.

The needle position detection section 34 detects whether or not the needle 12 attached to the needle bar 9 occupies a needle-down position where the needle penetrates the workpiece cloth or a needle-up position where the needle is located above the workpiece cloth W. The movement amount detection section 35 detects a movement amount of the feed dog of the above-described cloth feed mechanism or a movement amount of the embroidery frame 19, thereby detecting an amount of movement of the workpiece cloth W. The revolution detection section 36 detects the number of revolution of the main shaft 8. Detailed description of these sections 34 to 36 will be eliminated since each of them comprises a known optical sensor or encoder. The image synthesis section 37 synthesizes an image of the underside of the workplace cloth W obtained by the first imaging member 30 and an image of the underside of the workpiece cloth W obtained by the second imaging member 31 in the manner as will be described later.

Figure 5:
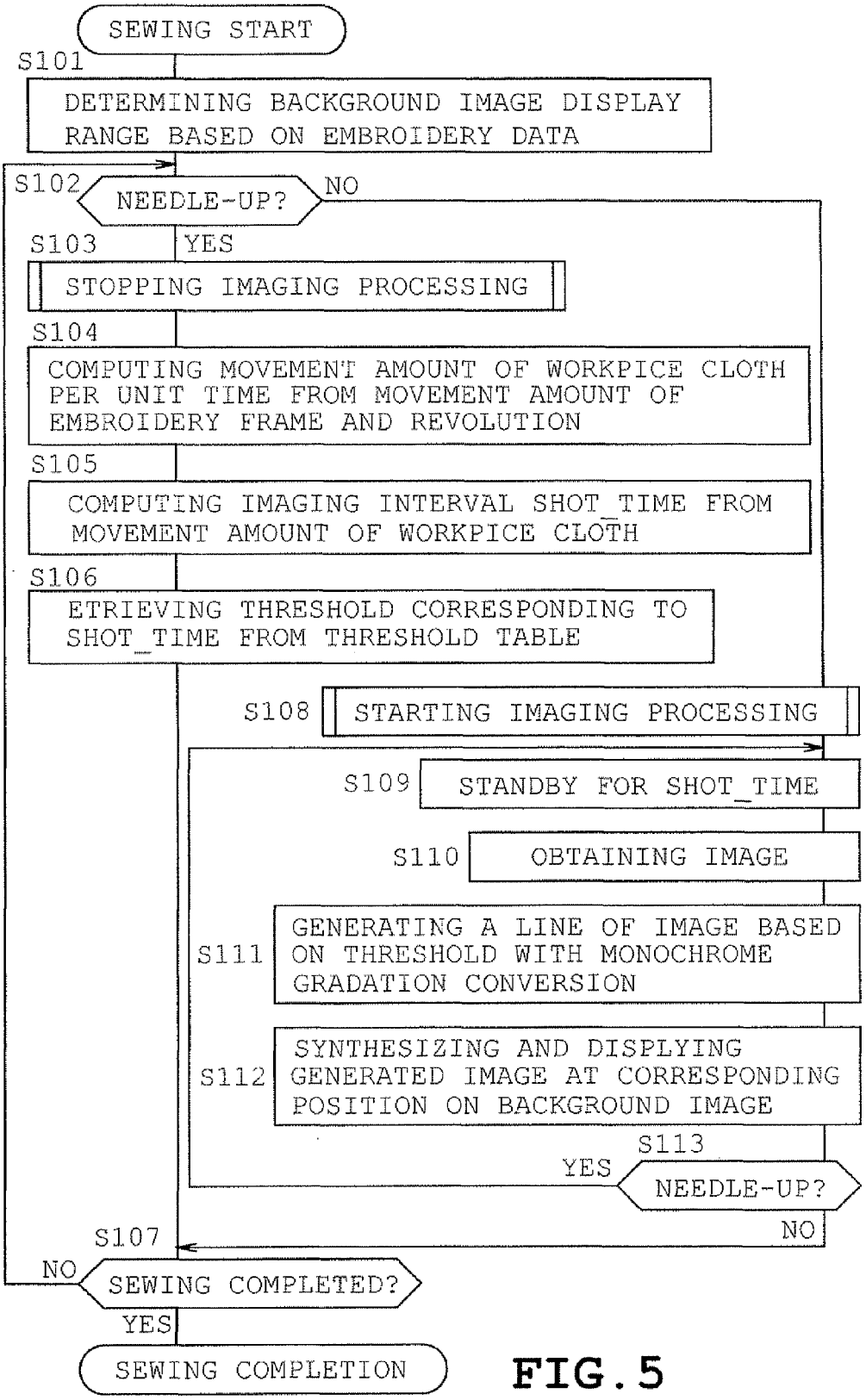
FIG. 5 is a flowchart showing a processing procedure for image display processing.

The operation of the sewing machine 1 will now be described together with an image displaying processing. The control section 32 of the sewing machine 1 executes the control of the entire sewing machine 1 and an image displaying processing as shown in FIG. 5. The processing in the embroidery sewing will be exemplified in the following description. Upon start of embroidery sewing by user's depression of the start/stop switch 15, the control section 32 determines a background image display range based on embroidery data (a contour and size of embroidery pattern) (step S101). The background image display range refers to a display range of the image of underside of the workplace cloth W to be displayed on the display 7. A location where sewing is to be executed is associated with a display location on a screen where an image of the underside of an embroidery pattern sewn onto the workpiece cloth is displayed on the basis of embroidery data of an embroidery pattern selected by the user.

Figure 6A:
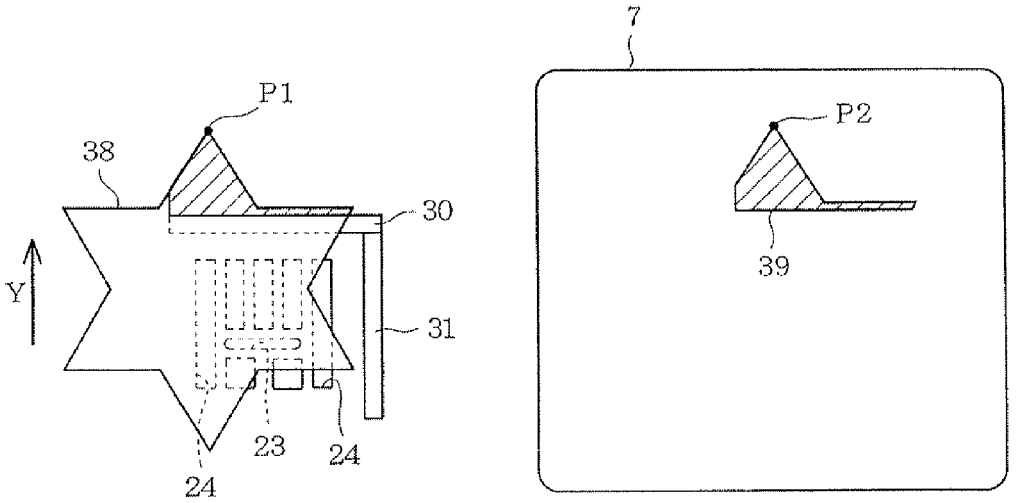
FIGS. 6A to 6C schematically illustrate embroidery sewing steps.
Figure 6B:
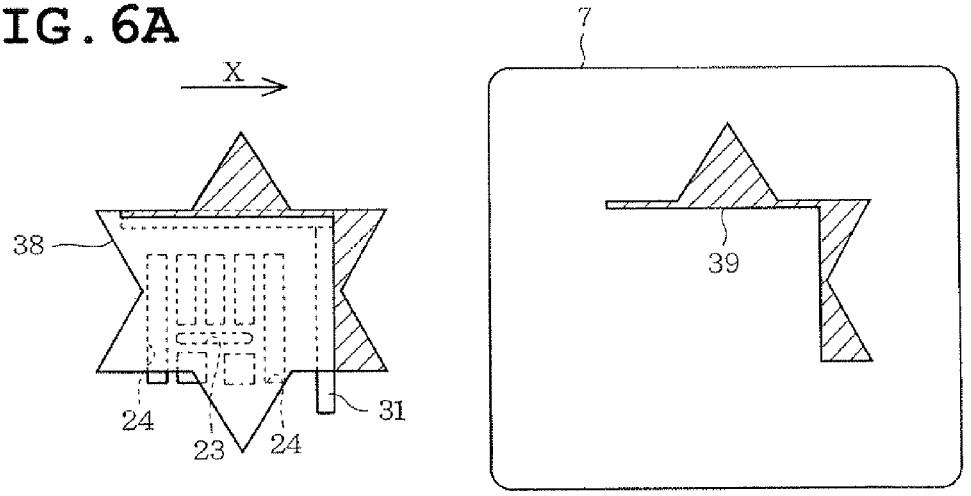
Figure 6C:
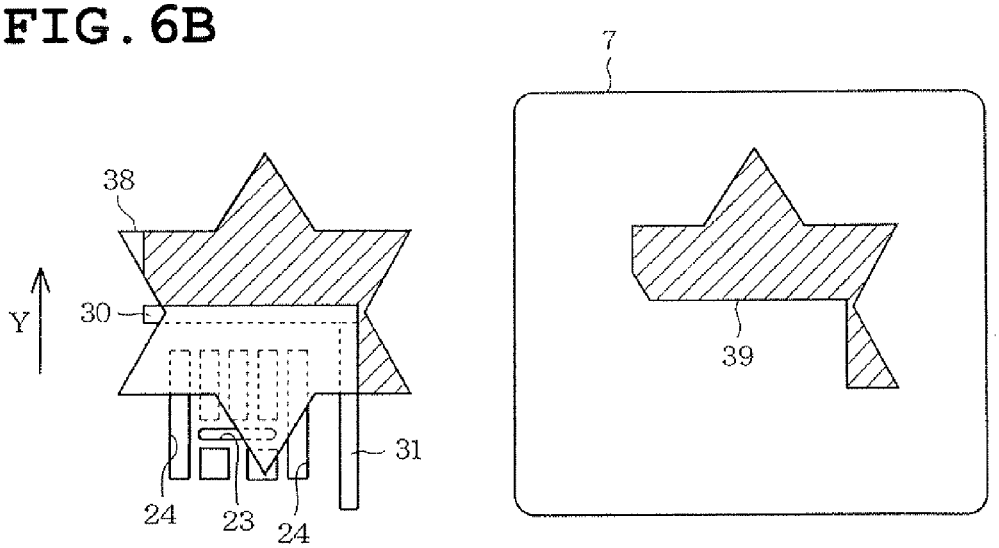

More specifically, the control section 32 determines a location of a predetermined point 22 on the display 7 as a point corresponding to a specified point P1 when starting the sewing at the point P1 on a star-shaped embroidery pattern 38 as shown in FIG. 6A, for example. The entire embroidery pattern 38 can be displayed on the display 7 when the point P2 is determined to be located on an upper part of the display 7. The control section 32 thus determines the background image display range. FIGS. 6A to 6C eliminate the needle 12 and the like and schematically illustrate hatched parts of the embroidery pattern which have been moved or passed along the upper surfaces of the first and second imaging members.

When having determined the background image display range, the control section 32 further determines whether or not the needle 12 is in a needle-up state (step S102). "Needle-up" means that the needle 12 occupies a predetermined location above the workpiece cloth W. The control section 32 determines whether or not the needle 12 is in the needle-up state, based on the location of the needle 12 detected by the needle position detection section 34. When determining that the needle 12 is not in the needle-up state (NO at step S102), the control section 32 stops the imaging process (step S103). When not in the needle-up state, the needle 12 is in the needle-down state where the needle 12 has penetrated the workpiece cloth W, occupying a predetermined location below the workpiece cloth W. In this case, the workpiece cloth W is stopped by the embroidery frame transfer device 5. Accordingly, the control section 32 stops the imaging process.

The control section 32 subsequently computes a movement amount of the workpiece cloth W per unit time from an movement amount of the embroidery frame 19 detected by the movement amount detection section 35 and a revolution of the main shaft 8 or a sewing speed detected by the revolution detection section 36. The movement amount detection section 35 also detects a moving direction of the workpiece cloth W (a cloth feed direction). The control section 32 then computes an imaging interval (SHOT_TIME) from the movement amount of the workpiece cloth W per unit time (step S105). When the imaging processing is executed with a constant imaging interval in a case where a movement amount of the workpiece cloth W is large, an interval (or distance) of imaging range of the workpiece cloth W is increased. In this case, it would be difficult to recognize a detailed state of the underside of the workpiece cloth W since an image to be obtained is discontinuous but not continuous. On the contrary, when a movement amount of the workpiece cloth W is small, the workpiece cloth W is imaged even though the workpiece cloth W is not almost moved, whereupon almost the same image is obtained at a plurality of times.

In view of the above-described problem, the control section 32 computes the imaging interval, based on the movement amount of the workpiece cloth W per unit time obtained at step S104 (step S105). More specifically, the imaging interval is rendered shorter when the movement amount of the workpiece cloth W is large, as shown in FIG. 7. The imaging interval is rendered longer when the movement amount of the workpiece cloth W is small. A data table as shown in FIG. 7 is stored on the ROM 32*b*. In the embodiment, four steps of imaging intervals are provided according to the movement amount of the workpiece cloth W per unit time. The data table of FIG. 7 exemplifies numerals and should not be limited to the numerals. Additionally, the imaging interval may be computed on the basis of a predetermined function expression instead of the use of the data table as shown in FIG. 7.

The control section 32 subsequently retrieves a threshold (THRESHOLD) corresponding to the imaging interval (SHOT_TIME) from the table of FIG. 7, based on the obtained imaging interval. The threshold is a reference value used in a case where the embroidery frame 38 is extracted in the obtained image. The ROM 32*b* stores threshold values corresponding to the four steps of imaging intervals respectively. In the embodiment, the thresholds are set so as to be smaller as the imaging interval is short. Any commercially available technique may be employed for image processing with the use of a threshold, and a detailed description of the threshold will be eliminated.

Upon completion of the computation of the imaging interval and the retrieval of the threshold, the control section 32 determines whether or not the sewing has been completed (step S107). When the sewing has not been completed (NO at step 107), the control section 32 proceeds to step S102, repeating the subsequent processing.

When determining that the needle 12 is in the needle-up state (YES at step S102), the control section 32 starts the imaging processing (step S108). After standby for the imaging interval (SHOT_TIME) obtained at step S105 (step S109), the control section 32 obtains an image (step S110). The control section 32 then generates a line of image of the underside of the workpiece cloth W with monochrome gradation conversion (S111), based on the threshold (THRESHOLD) used when the obtained image has been retrieved at step S106. For example, the embroidery pattern 38 passes over the upper surface of the first imaging member 30 while the workpiece cloth W is moving in the Y direction, as shown in FIG. 6A. In this case, the control section 32 generates a line of image of the underside of the workpiece cloth W from the image obtained by the first imaging member 30. The control section 32 also generates a line of image from the image of the underside of the workpiece cloth W obtained by the second imaging member 31. Subsequently, the image synthesis section 37 synthesizes the generated images, thereby obtaining a synthesized image. The control section 32 synthesizes the synthesized image at a corresponding location of the background image and displays thereby to display the same (step S112). Consequently, a synthesized image 39 of the embroidery pattern 38 which has moved over the upper surface of the first imaging member 30 is displayed on the display 7.

More specifically, when it is assumed that the sewing of the embroidery pattern 38 started at point P1, the workpiece cloth W is fed toward the rear of the sewing machine with progress of the sewing. The sewn embroidery pattern 38 is also moved rearward together with the workpiece cloth W. The control section 32 then obtains a line of image of the workpiece cloth W in the X direction, based on the detected movement amount of the workpiece cloth W and the detected moving direction (the feed direction). The aforementioned line of image includes the point P1 imaged when the point P1 of the embroidery pattern 38 has been located on the upper surface of the first imaging member 30. The control section 32 displays the point P1 in such a manner that the point P1 corresponds to the point P2 on the screen of the display section, based on the display range determined at step S101.

The control section 32 repeats display of a line of image with movement of the workpiece cloth W. As a result, lines of images are stacked on the screen of the display 7 such that an image of the hatched part of the underside of the embroidery pattern 38 is displayed, which hatched part has been moved along the upper surface of the first imaging member 30. Since the embroidery pattern 38 has not been moved along the upper surface of the second imaging member 31 in the case shown in FIG. 6A, it is determined that the image obtained by the second imaging member 31 contains no image of the embroidery pattern 38. Thus, the control section 32 displays on the display 7 the synthesized image 39 which has been synthesized from the images obtained by the first and second imaging members 30 and 31.

The control section 32 then determines whether or not the needle 12 is in the needle-up state (step S113). When determining that the needle 12 is in the needle-up state (YES at step S113), the control section 32 proceeds to step S109 to repeat the processing in the same manner. On the other hand, when determining that the needle 12 is not in the needle-up state (NO at step S113), the control section 32 proceeds to step S107 to determine whether or not the sewing has been completed. When the sewing has not been completed (NO at step S107), the control section 32 repeats the above-described imaging processing. When the workpiece cloth W has been moved along the upper surfaces of the first and second imaging members 30 and 31, the control section 32 controls the display 7 so that the synthesized image 39 obtained by synthesizing both images is displayed on the display 7. The synthesized image 39 is also displayed on the display 7 by the processing at step S112 even when the feed direction of the workpiece cloth W (the moving direction of the embroidery frame 38) has been changed, as shown in FIGS. 6B and 6C.

More specifically, even when the workpiece cloth W is reciprocally moved in the front-back or right-left direction, the imaging processing is carried out on the basis of the moving direction of the workpiece cloth W such that the synthesized image 39 can be displayed on the display 7 as the result of execution of the imaging processing on the basis of the moving direction of the workpiece cloth W. Of course, the image processing is commonly executed when the workpiece cloth W is simultaneously moved in the front-back direction and the right-left direction or in an oblique direction. The control section 32 finishes the image displaying processing when having determined that all the sewing has been completed as the result of the above-described repeated processing (YES at step 107).

The control section 32 thus controls the display 7 to display the synthesized image obtained from the images of the underside of the workpiece cloth W, based on the location of the needle bar 9 and the movement amount of the workpiece cloth W. In other words, the images of the underside of the workpiece cloth W during the sewing are displayed, whereby the user can easily recognize the state of the underside of the workpiece cloth W during the sewing.

The following advantageous effects can be achieved from the above-described first embodiment. The control section 32 of the sewing machine 1 controls the first and second imaging members 30 and 31 so that the first and second ranges of the underside of the workpiece cloth W are imaged by the first and second imaging members 30 and 31 during the sewing respectively. More specifically, different ranges of the underside of the workpiece cloth W are individually imaged. The control section 32 then synthesizes the images of the first and second ranges, thereby displaying the synthesized image on the display 7. In this case, it is supposed that the first and second ranges imaged by the first and second imaging members which are line sensors, respectively, are narrow. However, an image of the entire underside of the workpiece cloth can be displayed by synthesizing the images obtained by the first and second imaging members 30 and 31 respectively. In other words, the entire underside of the workpiece cloth W can be displayed even when the first and second imaging members comprise respective line sensors so as to be rendered smaller in size. The user can easily recognize the state of the underside of the workpiece cloth W when viewing the synthetic image displayed by the display 7. Consequently, a failure occurred during the sewing, such as the shift between overlapped workpiece cloths W or stitch failure can early be detected without an increase in the size of the bed 2 housing the first and second imaging members 30 and 31.

Each of the first and second imaging members 30 and 31 comprises the line sensor having the plural imaging devices arranged in the direction perpendicular to the cloth feed direction. Accordingly, since a space in the cloth feed direction may be small, the sizes of the first and second imaging members 30 and 31 can be reduced.

The underside of the workpiece cloth W is imaged by the first imaging member 30 while the workpiece cloth W is being moved in the X direction. The underside of the workpiece cloth W is imaged by the second imaging member 31 while the workpiece cloth W is being moved in the Y direction. Thus, the underside of the workpiece cloth W is imaged when the workpiece cloth W is moved in either direction. Consequently, the state of the underside of the workpiece cloth W can easily be recognized irrespective of the moving direction of the workpiece cloth W.

Each of the first and second imaging members 30 and 31 comprises the contact image sensor (CIS) which can image the underside of the workpiece cloth W while being in contact with the workpiece cloth W. This can realize the mounting of the imaging members 30 and 31 on the needle plate 20 (the first needle plate 21), thereby further reducing the mounting space of the imaging members 30 and 31. In this case, the first and second imaging members 30 and 31 are mounted so that the upper surfaces are coplanar or on a level with the upper surface of the needle plate 20. This mounting manner can prevent the first and second imaging members 30 and 31 from blocking the movement of the workpiece cloth W. Consequently, the workpiece cloth W can be moved and accordingly sewn smoothly.

Since the first and second imaging members 30 and 31 are disposed near the needle hole 23 or the feed-dog holes 24, the user can recognize the state of the underside of the workpiece cloth W after sewing or immediately after the forming of the stitches. This can provide an earlier detection of failure.

The control section 32 controls start and stop of the imaging processing based on the location of the needle 12. Unnecessary imaging is prevented when the workpiece cloth W is stopped. This can reduce load of the imaging processing executed by the control section 32.

Since the imaging interval is changed on the basis of the revolution of the main shaft 8 or the sewing speed, the interval for obtainment of the image of the workpiece cloth W can be set accurately. Consequently, the underside of the workpiece cloth W can be imaged more correctly.

Since the imaging interval is changed on the basis of the movement amount of the workpiece cloth W, the interval for obtainment of the image of the workpiece cloth W can be set accurately. Consequently, the underside of the workpiece cloth W can be imaged more correctly.

The sewing machine according to a second embodiment will be described with reference to FIG. 8. The second embodiment differs from the first embodiment in that two workpiece cloths are superimposed and moved by the feed mechanism 6 so that a straight stitch, a zigzag stitch, a decorative stitch or the like is carried out. The second embodiment is common to the first embodiment in the overall construction and the image displaying processing manner.

Figure 8:
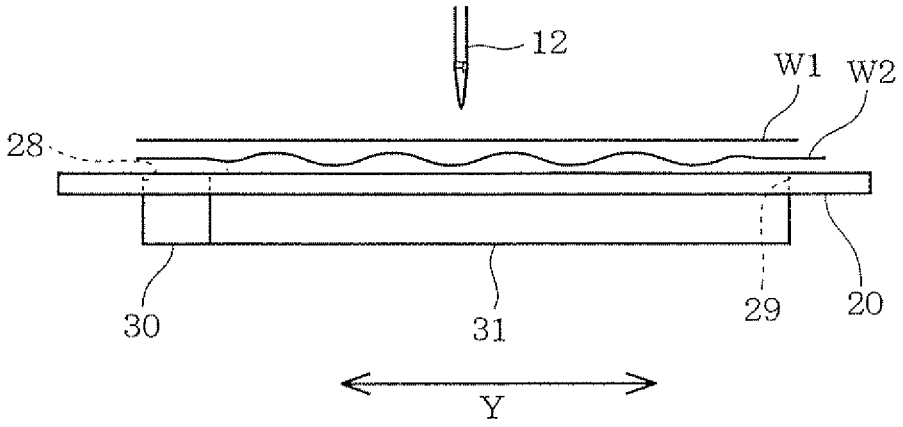
FIG. 8 illustrates a workpiece cloth processed by the sewing machine according to a second embodiment.

When two workpiece cloths W1 and W2 placed on the needle plate 20 are to be sewn in a superimposed state (a superimposed seam), a relative shift sometimes occurs between the upper and lower cloths W1 and W2 depending upon types of workpiece cloths (fabric quality), as shown in FIG. 8. In this case, the lower workpiece cloth W2 is invisible although the upper workpiece cloth W1 is visible. In view of the problem, the sewing machine according to the second embodiment executes the image displaying processing (see FIG. 5) in the similar manner to that in the first embodiment, whereby the underside of the lower workpiece cloth W2 is imaged by the first and second imaging members 30 and 31. The control section 32 controls the movement amount detection unit 35 at step S104 so that a movement amount of the feed dog is detected. The control section 32 computes a movement amount of the workpiece cloths W1 and W2 based on the detected movement amount of the feed dog.

The control section 32 then synthesizes the obtained images and displays the synthesized image on the display 7. As a result, the user can recognize the image of the underside of the lower workpiece cloth W. Accordingly, a failure in the sewing on the underside of the lower workpiece cloth W2 can early be detected, and the shift of the lower workpiece cloth W2 and seam defect can early be detected in the sewing.

The foregoing embodiments are not restrictive but may be modified or expanded as follows. Only the first imaging member 30 may be provided when the sewing machine is constructed so that the workpiece cloth W is fed only in the Y direction or the front-back direction.

The imaging devices of the first and second imaging members 30 and 31 are arranged in the direction perpendicular to the cloth feed direction (the X or Y direction) of the workpiece cloth W in the foregoing embodiments. However, the imaging devices may be arranged in a direction crossing the cloth feed direction at an angle other than 90°.

Although mounted on the needle plate 20 in the foregoing embodiments, the first and second imaging members 30 and 31 may be mounted directly on the bed 2, instead. Furthermore, the locations of the first and second imaging members 30 and 31 may be selectable according to the structure of the bed 2 and the disposition of the mechanisms in the bed 2.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. A sewing machine comprising:

a sewing machine bed configured so that a workpiece cloth is placed thereon;

a feed mechanism provided in the bed and configured to move the workpiece cloth in a predetermined direction;

a needle bar configured to accept a needle;

a needle bar mechanism configured to drive the needle bar upward and downward;

a needle position detector configured to detect whether or not the needle occupies a needle-down position where the needle penetrates the workpiece cloth or a needle-up position where the needle is located above the workpiece cloth;

a first imaging member provided on the bed and configured to image a first range of an underside of the workpiece cloth while the workpiece cloth is being moved by the feed mechanism;

a second imaging member provided on the bed and configured to image a second range of the underside of the workpiece cloth while the workpiece cloth is being moved by the feed mechanism, the second range differing from the first range;

an imaging control unit configured to control an imaging process so that the imaging process is executed by the first imaging unit and the second imaging unit when the needle is located at the needle-up position, based on a result of detection by the needle position detector and so that the imaging process is stopped by the first and second imaging units when the needle is located at the needle-down position, based on a result of detection by the needle position detector;

an image synthesis unit configured to synthesize the images obtained by the first and second imaging units, thereby obtaining a synthesized image; and a display unit configured to display the synthesized image obtained by the image synthesis unit.

2. A sewing machine comprising:

a sewing machine bed configured so that a workpiece cloth is placed thereon;

a feed mechanism provided in the bed and configured to move the workpiece cloth in a predetermined direction;

a needle bar configured to accept a needle;

a needle bar mechanism configured to drive the needle bar upward and downward;

a needle position detector configured to detect whether or not the needle is located at a needle-down position where the needle penetrates the workpiece cloth or a needle-up position where the needle is located above the workpiece cloth; and an imaging member provided on the bed and having a plurality of imaging devices arranged in a direction intersecting the predetermined direction in which the workpiece cloth is moved by the feed mechanism, the imaging member being configured to image an underside of the workpiece cloth while the workpiece cloth is being moved by the feed mechanism;

an imaging control unit configured to control an imaging process so that the imaging process is executed by the imaging member when the needle is located at the needle-up position, based on a result of detection by the needle position detector and so that the imaging process by the first and second imaging units is stopped when the needle is located at the needle-down position, based on a result of detection by the needle position detector; and a display unit configured to display the image obtained by the imaging unit.

3. The sewing machine according to claim 1, wherein the predetermined direction includes a first direction and a second direction differing from the first direction.

4. The sewing machine according to claim 2, wherein the predetermined direction includes a first direction and a second direction differing from the first direction.

5. The sewing machine according to claim 1, wherein the first and second imaging members comprise contact image sensors which are capable of imaging the workpiece cloth while being in contact with the underside of the work piece cloth, respectively.

6. The sewing machine according to claim 2, wherein the imaging member comprises a contact image sensor which is capable of imaging the workpiece cloth while being in contact with the underside of the work piece cloth.

7. The sewing machine according to claim 3, wherein the first and second imaging members comprise contact image sensors which are capable of imaging the workpiece cloth while being in contact with the underside of the work piece cloth, respectively.

8. The sewing machine according to claim 4, wherein the imaging member comprises a contact image sensor which is capable of imaging the workpiece cloth while being in contact with the underside of the work piece cloth.

9. The sewing machine according to claim 1, further comprising a needle plate provided in the bed and having a first through hole and a second through hole, wherein the cloth feed mechanism includes a feed dog which is caused to protrude out of and to retract into the first hole, and the first and second imaging members are disposed near the first or second hole of the needle plate.

10. The sewing machine according to claim 2, further comprising a needle plate provided in the bed and having a first through hole and a second through hole, wherein the cloth feed mechanism includes a feed dog which is caused to protrude out of and to retract into the first hole, and the imaging unit is disposed near the first or second hole of the needle plate.

11. The sewing machine according to claim 1, further comprising a sewing machine main shaft which drives the needle bar mechanism and a revolution detection unit which detects a revolution of the sewing machine main shaft, wherein the imaging control unit changes an interval of an imaging process by the imaging unit based on the revolution detected by the revolution detection unit.

12. The sewing machine according to claim 2, further comprising a sewing machine main shaft which drives the needle bar mechanism and a revolution detection unit which detects a revolution of the sewing machine main shaft, wherein the imaging control unit changes an interval of an imaging process by the imaging unit based on the revolution detected by the revolution detection unit.

13. The sewing machine according to claim 1, further comprising a movement amount detection unit which detects a movement amount of the workpiece cloth fed by the cloth feeding mechanism, wherein the imaging control unit changes an interval of an imaging process by the imaging unit based on the movement amount detected by the movement amount detection unit.

14. The sewing machine according to claim 2, further comprising a movement amount detection unit which detects a movement amount of the workpiece cloth fed by the cloth feeding mechanism, wherein the imaging control unit changes an interval of imaging processing by the imaging unit based on the movement amount detected by the movement amount detection unit.

15. The sewing machine according to claim 11, further comprising a movement amount detection unit which detects a movement amount of the workpiece cloth fed by the cloth feeding mechanism, wherein the imaging control unit changes an interval of imaging processing by the imaging unit based on the movement amount detected by the movement amount detection unit.

16. The sewing machine according to claim 12, further comprising a movement amount detection unit which detects an a movement amount of the workpiece cloth fed by the cloth feeding mechanism, wherein the imaging control unit changes an interval of imaging processing by the imaging unit based on the movement amount detected by the movement amount detection unit.

* * * * *